US010036544B1

(12) United States Patent
Shum

(10) Patent No.: US 10,036,544 B1
(45) Date of Patent: Jul. 31, 2018

(54) ILLUMINATION SOURCE WITH REDUCED WEIGHT

(71) Applicant: SORAA, INC., Fremont, CA (US)

(72) Inventor: Frank Tin Chung Shum, Sunnyvale, CA (US)

(73) Assignee: Soraa, Inc., Fremont, CA (US)

( * ) Notice: Subject to any disclaimer, the term of this patent is extended or adjusted under 35 U.S.C. 154(b) by 551 days.

(21) Appl. No.: 13/945,763

(22) Filed: Jul. 18, 2013

Related U.S. Application Data

(63) Continuation-in-part of application No. 29/441,108, filed on Dec. 31, 2012, now Pat. No. Des. 730,302, and a continuation-in-part of application No. 13/025,833, filed on Feb. 11, 2011, now Pat. No. 8,643,257.

(60) Provisional application No. 61/673,153, filed on Jul. 18, 2012.

(51) Int. Cl.
*F21V 29/00* (2015.01)

(52) U.S. Cl.
CPC ..... *F21V 29/22* (2013.01)

(58) Field of Classification Search
CPC ..... F21Y 2103/003; F21V 29/20
USPC ..... 362/646
See application file for complete search history.

(56) References Cited

U.S. PATENT DOCUMENTS

| | | | |
|---|---|---|---|
| 2,953,970 | A | 9/1960 | Maynard |
| 3,283,143 | A | 11/1966 | Gosnell |
| 3,593,021 | A | 7/1971 | Auerbach |
| 3,621,233 | A | 11/1971 | Ferdinand et al. |
| 3,874,443 | A | 4/1975 | Bayer, Jr. |
| 4,165,919 | A | 8/1979 | Little |
| 4,225,904 | A | 9/1980 | Linder |
| 4,279,463 | A | 7/1981 | Little |
| 4,293,892 | A | 10/1981 | Plummer |
| 5,005,109 | A | 4/1991 | Carleton |
| 5,764,674 | A | 6/1998 | Hibbs-Brenner et al. |
| 6,116,758 | A | 9/2000 | Lin |
| 6,204,602 | B1 | 3/2001 | Yang et al. |
| 6,501,154 | B2 | 12/2002 | Morita et al. |

(Continued)

FOREIGN PATENT DOCUMENTS

| | | |
|---|---|---|
| CN | 1849707 | 10/2006 |
| CN | 2826150 Y | 10/2006 |

(Continued)

OTHER PUBLICATIONS

Communication from the Chinese Patent Office re 201210322687.1 dated Mar. 3, 2014, 8 pages.

(Continued)

*Primary Examiner* — Sean Gramling
*Assistant Examiner* — Gerald J Sufleta, II
(74) *Attorney, Agent, or Firm* — FisherBroyles LLP

(57) ABSTRACT

Illumination sources including a light generation portion comprising an LED assembly configured to output light at a first intensity while generating a first quantity of heat per unit time are disclosed. The heat dissipation portion comprises an MR-16 form factor heat sink configured to dissipate at least the first quantity of heat per unit time, wherein the light generation portion and the heat dissipation portion are characterized a first mass, and wherein a ratio of the first intensity to the first mass is within a range of about 10 lumens per gram to about 30 lumens per gram.

21 Claims, 9 Drawing Sheets

(56) References Cited

U.S. PATENT DOCUMENTS

D471,881 S 3/2003 Hegde
6,787,999 B2 9/2004 Stimac et al.
6,853,010 B2 2/2005 Slater, Jr. et al.
6,864,572 B2 3/2005 Lee et al.
6,889,006 B2 5/2005 Kobayashi
6,942,368 B1 9/2005 Kane et al.
6,964,877 B2 11/2005 Chen et al.
7,053,413 B2 5/2006 D'Evelyn et al.
7,148,515 B1 12/2006 Huang et al.
7,207,694 B1 4/2007 Petrick
7,220,324 B2 5/2007 Baker et al.
D545,457 S 6/2007 Chen
7,252,408 B2 8/2007 Mazzochette et al.
7,253,446 B2 8/2007 Sakuma et al.
7,311,417 B1 12/2007 Lemke
7,338,828 B2 3/2008 Imer et al.
7,344,279 B2 3/2008 Mueller et al.
7,388,751 B2 6/2008 Hood et al.
7,431,071 B2 10/2008 Wenger
D581,583 S 11/2008 Peng
7,458,706 B1 12/2008 Liu et al.
7,488,097 B2 2/2009 Reisenauer et al.
7,506,998 B2 3/2009 Ansems et al.
D592,613 S 5/2009 Plonski et al.
7,550,305 B2 6/2009 Yamagata et al.
7,631,987 B2 12/2009 Wei
7,637,635 B2 12/2009 Xiao et al.
7,658,528 B2 2/2010 Hoelen et al.
7,663,229 B2 2/2010 Lu et al.
7,674,015 B2 3/2010 Chien
7,712,922 B2 5/2010 Hacker et al.
D618,634 S 6/2010 Lin et al.
7,744,259 B2 6/2010 Walczak et al.
D619,551 S 7/2010 Lin et al.
7,748,870 B2 7/2010 Chang et al.
7,753,107 B2 7/2010 Zhou et al.
7,795,600 B2 * 9/2010 Beeson ..... H05B 33/10 250/483.1
7,800,119 B2 9/2010 He et al.
7,824,075 B2 11/2010 Maxik
7,824,077 B2 11/2010 Chen et al.
7,889,421 B2 2/2011 Narendran et al.
7,972,040 B2 7/2011 Li et al.
7,993,025 B2 8/2011 Chiu
7,993,031 B2 8/2011 Grajcar
7,997,774 B2 8/2011 Liddle
8,042,969 B2 10/2011 Paik et al.
8,049,122 B2 11/2011 Watford
D652,564 S 1/2012 Maxik
8,153,475 B1 4/2012 Shum et al.
8,157,422 B2 4/2012 Paik et al.
8,164,237 B2 4/2012 Wen
8,206,015 B2 6/2012 Cho et al.
D662,899 S 7/2012 Shum et al.
D662,900 S 7/2012 Shum et al.
8,215,800 B2 7/2012 Plank
8,220,970 B1 7/2012 Khazi et al.
8,227,962 B1 7/2012 Su
8,242,669 B2 8/2012 Qiu
8,272,762 B2 9/2012 Maxik et al.
8,324,835 B2 12/2012 Shum et al.
D674,960 S 1/2013 Chen et al.
8,390,207 B2 3/2013 Dowling et al.
8,405,947 B1 3/2013 Green et al.
8,414,151 B2 4/2013 Allen et al.
8,525,396 B2 9/2013 Shum et al.
8,567,999 B2 10/2013 Paik et al.
8,579,470 B1 11/2013 Leahy et al.
D694,722 S 12/2013 Shum et al.
8,618,742 B2 12/2013 Shum et al.
8,643,257 B2 2/2014 Shum et al.
8,651,711 B2 2/2014 Rudisill et al.
8,680,787 B2 3/2014 Veskovic
8,746,918 B1 6/2014 Rubino
8,752,975 B2 6/2014 Rubino
8,803,452 B2 8/2014 Shum et al.
8,829,774 B1 9/2014 Shum et al.
8,884,501 B2 11/2014 Cho et al.
8,884,517 B1 11/2014 Shum et al.
8,888,332 B2 11/2014 Martis et al.
2001/0021073 A1 9/2001 Leggo et al.
2003/0039122 A1 2/2003 Cao
2003/0058650 A1 3/2003 Shih
2003/0107885 A1 6/2003 Galli
2003/0183835 A1 10/2003 Moku et al.
2004/0222427 A1 11/2004 Hsiung
2004/0264195 A1 12/2004 Chang et al.
2005/0122690 A1 6/2005 Hood et al.
2005/0174780 A1 * 8/2005 Park ..... 362/294
2005/0214992 A1 9/2005 Chakraborty et al.
2006/0028310 A1 2/2006 Asano et al.
2006/0065900 A1 3/2006 Hsieh et al.
2006/0152795 A1 7/2006 Yang
2006/0175045 A1 8/2006 Chen
2006/0208262 A1 9/2006 Sakuma et al.
2006/0240585 A1 10/2006 Epler et al.
2006/0262545 A1 11/2006 Piepgras et al.
2006/0274529 A1 12/2006 Cao
2007/0007898 A1 1/2007 Bruning
2007/0158797 A1 7/2007 Lee
2007/0228999 A1 10/2007 Kit
2007/0284564 A1 12/2007 Biwa et al.
2008/0002444 A1 1/2008 Shekhawat et al.
2008/0049399 A1 2/2008 Lu et al.
2008/0080137 A1 4/2008 Otsuki et al.
2008/0123341 A1 5/2008 Chiu
2008/0142781 A1 6/2008 Lee
2008/0158887 A1 7/2008 Zhu et al.
2008/0164489 A1 7/2008 Schmidt et al.
2008/0266866 A1 10/2008 Tsai
2008/0315228 A1 12/2008 Krames et al.
2009/0027878 A1 1/2009 Metz et al.
2009/0072252 A1 3/2009 Son et al.
2009/0134421 A1 5/2009 Negley
2009/0154166 A1 6/2009 Zhang et al.
2009/0161356 A1 6/2009 Negley et al.
2009/0173958 A1 7/2009 Chakraborty et al.
2009/0175043 A1 7/2009 Frick
2009/0194252 A1 8/2009 Lee et al.
2009/0195186 A1 8/2009 Guest et al.
2009/0231895 A1 9/2009 Hu
2009/0237940 A1 9/2009 Wu et al.
2009/0244899 A1 10/2009 Chyn
2009/0303738 A1 12/2009 Suss et al.
2009/0303762 A1 12/2009 Jang et al.
2009/0315965 A1 12/2009 Yamagata et al.
2010/0003492 A1 1/2010 D'Evelyn
2010/0025656 A1 2/2010 Raring et al.
2010/0060130 A1 3/2010 Li
2010/0061076 A1 3/2010 Mandy et al.
2010/0066266 A1 3/2010 Huang et al.
2010/0091487 A1 4/2010 Shin
2010/0148145 A1 6/2010 Ishibashi et al.
2010/0207502 A1 8/2010 Cao et al.
2010/0207534 A1 8/2010 Dowling et al.
2010/0244648 A1 9/2010 Yoo
2010/0264799 A1 10/2010 Liu et al.
2010/0277068 A1 11/2010 Broitzman
2010/0290229 A1 11/2010 Meyer, Sr. et al.
2010/0320499 A1 12/2010 Catalano et al.
2011/0018418 A1 1/2011 Yoo
2011/0032708 A1 2/2011 Johnston et al.
2011/0056429 A1 3/2011 Raring et al.
2011/0074270 A1 3/2011 Van De Ven et al.
2011/0075422 A1 * 3/2011 Van De Ven et al. ... 362/249.02
2011/0095686 A1 4/2011 Falicoff et al.
2011/0140150 A1 6/2011 Shum
2011/0140586 A1 6/2011 Wang
2011/0169406 A1 7/2011 Weekamp et al.
2011/0175510 A1 7/2011 Rains, Jr. et al.
2011/0175528 A1 7/2011 Rains, Jr. et al.
2011/0182056 A1 7/2011 Trottier et al.
2011/0182065 A1 7/2011 Negley et al.
2011/0186874 A1 8/2011 Shum

(56) References Cited

U.S. PATENT DOCUMENTS

| | | | | |
|---|---|---|---|---|
| 2011/0186887 | A1 | 8/2011 | Trottier et al. | |
| 2011/0198979 | A1 | 8/2011 | Shum et al. | |
| 2011/0204763 | A1 | 8/2011 | Shum et al. | |
| 2011/0204779 | A1 | 8/2011 | Shum et al. | |
| 2011/0204780 | A1 | 8/2011 | Shum et al. | |
| 2011/0215348 | A1 | 9/2011 | Trottier et al. | |
| 2011/0215699 | A1 | 9/2011 | Le et al. | |
| 2011/0242823 | A1 | 10/2011 | Tracy et al. | |
| 2011/0260945 | A1 | 10/2011 | Karasawa | |
| 2011/0298371 | A1 | 12/2011 | Brandes et al. | |
| 2011/0309734 | A1 | 12/2011 | Lin et al. | |
| 2012/0018754 | A1 | 1/2012 | Lowes | |
| 2012/0043552 | A1 | 2/2012 | David et al. | |
| 2012/0043913 | A1 | 2/2012 | Melanson | |
| 2012/0086028 | A1* | 4/2012 | Beeson | H01L 33/501 257/98 |
| 2012/0161626 | A1 | 6/2012 | van de Ven et al. | |
| 2012/0187830 | A1 | 7/2012 | Shum et al. | |
| 2012/0212960 | A1 | 8/2012 | Rodriguez | |
| 2012/0293062 | A1 | 11/2012 | Pickard | |
| 2012/0314403 | A1 | 12/2012 | Kennedy et al. | |
| 2012/0319148 | A1 | 12/2012 | Donofrio et al. | |
| 2012/0320579 | A1 | 12/2012 | Ferguson et al. | |
| 2013/0058099 | A1 | 3/2013 | Shum et al. | |
| 2013/0322089 | A1 | 12/2013 | Martis et al. | |
| 2013/0343062 | A1 | 12/2013 | Shum et al. | |
| 2014/0028214 | A1 | 1/2014 | Mazumdar et al. | |
| 2014/0091697 | A1 | 4/2014 | Shum | |
| 2014/0146545 | A1 | 5/2014 | Shum et al. | |
| 2014/0175966 | A1 | 6/2014 | Tan | |
| 2014/0313749 | A1 | 10/2014 | Shum et al. | |
| 2014/0369030 | A1* | 12/2014 | Livesay | H01L 33/642 362/147 |

FOREIGN PATENT DOCUMENTS

| | | |
|---|---|---|
| CN | 2009-75612 | 11/2007 |
| CN | 101608746 | 8/2011 |
| CN | 102149960 | 8/2011 |
| CN | 203099372 U | 7/2013 |
| JP | 02-028541 | 1/1990 |
| JP | 2000-517465 | 12/2000 |
| JP | 2005-302483 | 10/2009 |
| JP | 2011-501351 | 1/2011 |
| WO | WO 2009/048956 | 3/2009 |
| WO | WO 2009/149263 | 12/2009 |
| WO | WO 2009/156969 | 12/2009 |
| WO | WO 2011/054716 | 5/2011 |

OTHER PUBLICATIONS

USPTO Office Action for U.S. Appl. No. 13/535,142 dated Feb. 25, 2014, 23 pages.
Thermal Properties of Plastic Materials', Professional Plastics, Aug. 21, 2010, pp. 1-4.
USPTO Notice of Allowance for U.S. Appl. No. 13/269,193 dated Mar. 31, 2014 (8 pages).
USPTO Office Action for U.S. Appl. No. 13/274,489 dated Mar. 27, 2014 (14 pages).
USPTO Office Action for U.S. Appl. No. 13/480,767 dated Apr. 29, 2014 (21 pages).
Communication from the Japanese Patent Office re 2013532993 dated Jul. 9, 2014 (5 pages).
USPTO Notice of Allowance for U.S. Appl. No. 13/959,422 dated Jul. 9, 2014 (7 pages).
USPTO Notice of Allowance for U.S. Appl. No. 13/274,489 dated Sep. 30, 2014 (7 pages).
USPTO Office Action for U.S. Appl. No. 13/535,142 dated Sep. 22, 2014 (25 pages).
USPTO Notice of Allowance for U.S. Appl. No. 13/856,613 dated Nov. 21, 2014 (8 pages).
USPTO Notice of Allowance for U.S. Appl. No. 13/909,752 dated Sep. 30, 2014 (9 pages).
USPTO Office Action for U.S. Appl. No. 14/014,112 dated Nov. 19, 2014 (24 pages).
USPTO Office Action for U.S. Appl. No. 14/054,597 dated Dec. 5, 2014 (9 pages).
USPTO Office Action for U.S. Appl. No. 14/075,936 dated Sep. 24, 2014 (7 pages).
USPTO Office Action for U.S. Appl. No. 14/097,043 dated Oct. 15, 2014 (11 pages).
USPTO Office Action for U.S. Appl. No. 14/211,606 dated Nov. 28, 2014 (18 pages).
Communication from the Chinese Patent Office re 2011800543977 dated Jan. 7, 2015 (13 pages).
USPTO Office Action for U.S. Appl. No. 13/480,767 dated Dec. 18, 2014 (17 pages).
USPTO Office Action for U.S. Appl. No. 13/855,423 dated Mar. 17, 2015 (22 pages).
USPTO Notice of Allowance for U.S. Appl. No. 29/441,108 dated Mar. 13, 2015 (7 pages).
USPTO Notice of Allowance for U.S. Appl. No. 29/469,709 dated Feb. 6, 2015 (5 pages).
Haskell et al., 'Defect Reduction in (1100) m-plane gallium nitride via lateral epitaxial overgrowth by hydride vapor phase epitaxy', Applied Physics Letters 86, 111917 (2005), pp. 1-3.
International Preliminary Report & Written Opinion of PCT Application No. PCT/US2011/060030 dated Mar. 21, 2012, 11 pgs. total.
CFL Ballast IC Drive LED', www.placardshop.com, Blog, May 22, 2012, 3 pgs.
Rausch, 'Use a CFL ballast to drive LEDs', EDN Network, 2007, pp. 1-2.
USPTO Office Action for U.S. Appl. No. 12/785,953 dated Apr. 12, 2012, 12 pages.
USPTO Office Action for U.S. Appl. No. 12/785,953 dated Jan. 11, 2013, 15 pages.
USPTO Office Action for U.S. Appl. No. 13/025,791 dated Nov. 25, 2011, 12 pages.
USPTO Office Action for U.S. Appl. No. 13/025,791 dated Feb. 20, 2013, 14 pages.
USPTO Notice of Allowance for U.S. Appl. No. 13/025,791 dated Jun. 17, 2013, 8 pages.
USPTO Office Action for U.S. Appl. No. 13/025,833 dated Dec. 14, 2011, 11 pages.
USPTO Office Action for U.S. Appl. No. 13/025,833 dated Jul. 12, 2012, 16 pages.
USPTO Office Action for U.S. Appl. No. 13/025,833 dated Apr. 26, 2013, 23 pages.
USPTO Office Action for U.S. Appl. No. 13/025,849 dated Mar. 15, 2013, 18 pages.
USPTO Notice of Allowance for U.S. Appl. No. 13/025,849 dated Sep. 16, 2013, 10 pages.
USPTO Office Action for U.S. Appl. No. 13/025,860 dated Dec. 30, 2011, 10 pages.
USPTO Notice of Allowance for U.S. Appl. No. 13/025,860 dated Jun. 8, 2012, 10 pages.
USPTO Office Action for U.S. Appl. No. 13/274,489 dated Sep. 6, 2013, 16 pages.
USPTO Office Action for U.S. Appl. No. 13/535,142 dated Aug. 1, 2013, 14 pages.
USPTO Notice of Allowance for U.S. Appl. No. 29/399,523 dated Mar. 5, 2012, 8 pages.
USPTO Notice of Allowance for U.S. Appl. No. 29/399,524 dated Mar. 2, 2012, 9 pages.
USPTO Notice of Allowance for U.S. Appl. No. 29/423,725 dated Jul. 19, 2013, 11 pages.
Tyagi et al., "Partial strain relaxation via misfit dislocation generation at heterointerfaces in (Al,In)GaN expitaxial layers grown on semipolar (112) GaN free standing substrates", *Applied Physics Letters* 95, 2510905 (2009).
Nakamura, 'Candela-Class High-Brightness InGaN/AlGaN Double-Heterostructure Blue-Light-Emitting Diodes', Applied Physics Letters, vol. 64, No. 13, Mar. 1994, pp. 1687-1689.

(56) References Cited

OTHER PUBLICATIONS

Communication from the Japanese Patent Office re 2012191931, dated Oct. 11, 2013, 4 pages.
USPTO Notice of Allowance for U.S. Appl. No. 13/025,833 dated Oct. 11, 2013 (11 pages).
USPTO Office Action for U.S. Appl. No. 13/269,193 dated Oct. 3, 2013 (12 pages).
USPTO Office Action for U.S. Appl. No. 13/480,767 dated Oct. 25, 2013 (28 pages).
USPTO Office Action for U.S. Appl. No. 13/535,142 dated Nov. 14, 2013 (23 pages).
USPTO Office Action for U.S. Appl. No. 13/959,422 dated Oct. 8, 2013 (10 pages).

* cited by examiner

ILLUMINATION SOURCE WITH REDUCED WEIGHT

The present application claims the benefit under 35 U.S.C. § 119(e) of U.S. Application No. 61/673,153, filed on Jul. 18, 2012, and this application claims priority to U.S. application Ser. No. 29/441,108 filed on Dec. 31, 2012, each of which is incorporated by reference in its entirety.

FIELD

This disclosure relates to high efficiency lighting sources and more particularly to light emitting diode (LED) illumination sources with reduced weight.

BACKGROUND

One characteristic of LED lamps is that high power light output correlates with high heat generation, and the need for heat sinks or other techniques for dissipation and radiation of this heat. Unfortunately, because heat dissipation is currently a major challenge, heat sinks for LED lamps often have a significant amount of mass, and thus, weight Accordingly, such limitations detract from the utility of the resulting lamps.

One approach considered has been to increase the size of the heat sink for a given lamp configuration, however, in conventional embodiments, large heat sinks can reduce the utility of an LED lamp (see examples below). Another approach has been to improve efficiency for light output such that a lamp can have a high ratio of light output to mass of the heat sink. This has been an elusive goal, until the advent of techniques disclosed herein.

Having small heat sinks with a high ratio of light output to mass is especially important for the case where LEDs lamps are placed in lighting enclosures that have poor air circulation. A typical example is a recessed ceiling enclosure, where the temperature can be over 50 degrees C. At such, temperatures, the emissivity of heat sink surfaces plays only a small role in dissipating heat. Therefore, other techniques must be used for dissipation and radiation of heat generated by high power light outputting devices. Additionally, because conventional electronic assembly techniques and LED reliability factors limit printed circuit board temperatures to no greater than about 85 degrees C., the power output of the LEDs is also constrained by heat dissipation. Still further, because total light output from LED lighting sources can be increased by simply increasing the number of LEDs, this has led to increased device costs, increased device size, and increased weight of the LED illumination source.

Although lighter weight LED illumination sources are desired, for at least the aforementioned reasons, conventional light sources typically use large passive heat sinks (sometimes massive heat sinks). Further, smaller LED illumination sources are also desired, yet, for at least the aforementioned reasons, conventional sources use larger-than-needed form factors.

DETAILED DESCRIPTION

Figure 1A:
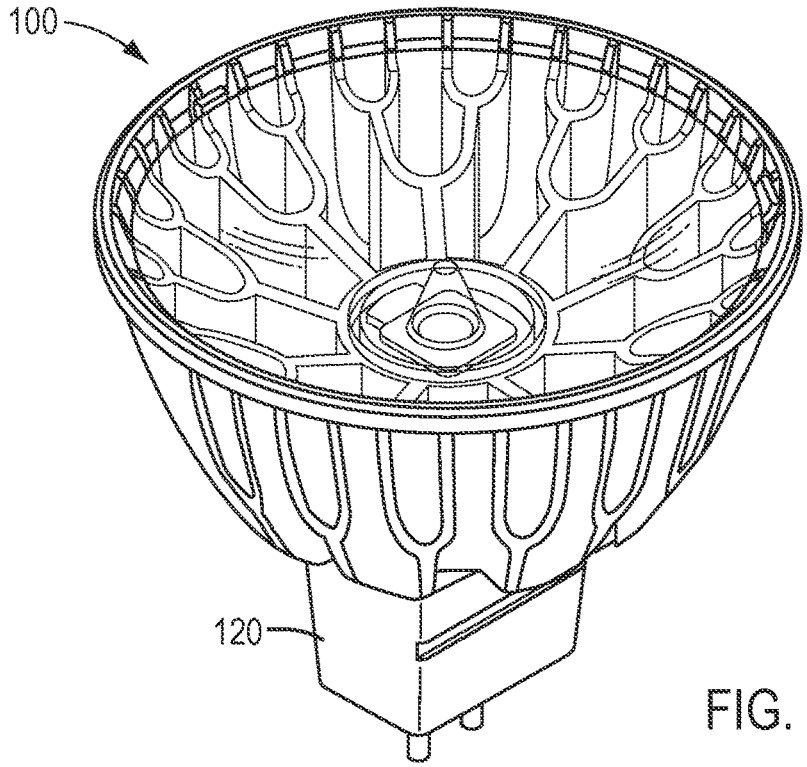
FIG. 1A is a perspective view of an MR-16 form factor implementation of certain embodiments provided by the disclosure.
Figure 1B:
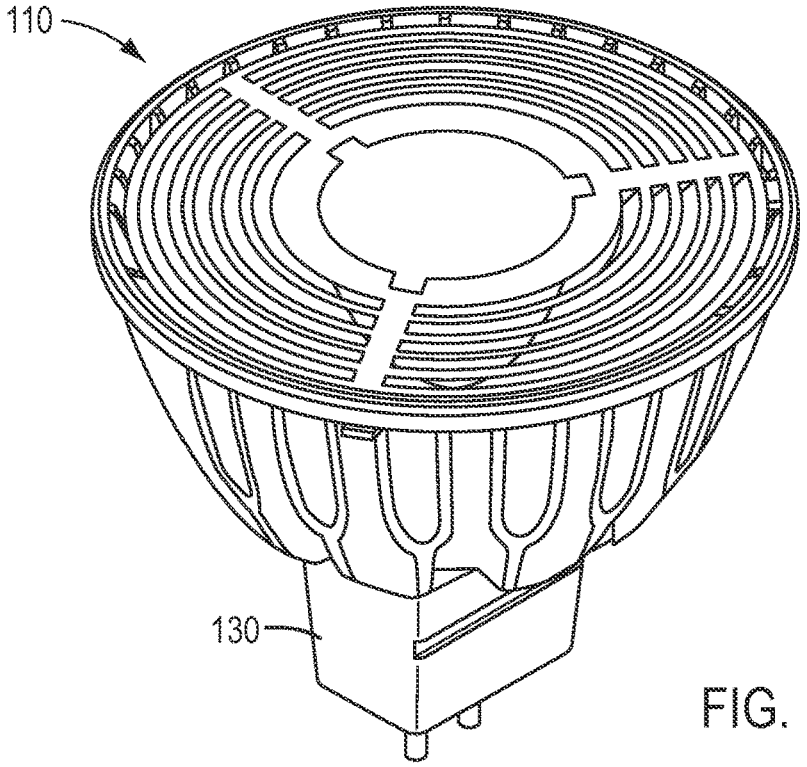
FIG. 1B is a perspective view of an MR-16 form factor implementations of certain embodiments provided by the disclosure.

FIG. 1A and FIG. 1B illustrate two embodiments of the present disclosure. More specifically, FIG. 1A and FIG. 1B illustrate embodiments of MR-16 form factor compatible LED lighting sources 100 and 110 having a GU 5.3 form factor compatible base 120 and base 130, respectively. MR-16 lighting sources typically operate with 12 volt alternating current (VAC). In FIG. 1A LED lighting source 100 provides a spot light having a 10 degree beam, and in FIG. 1B LED lighting source 110 provides a flood light having a 25 degree to 40 degree beam.

In these embodiments, even though the MR-16 form factor is followed (e.g., having some physical characteristics in adherence to the MR-16 form factor), the MR-16 form factor or MR-16 standard specification does not specify or require any particular weight characteristics. The MR-16 designation is a "coded" designation in which "MR" stands for multifaceted reflector, and "16" refers to the diameter in eighths of an inch across the front face of the lamp. Thus, an MR-16 lamp is 2 inches (51 mm) in diameter and an MR-11 is 11 eighths of an inch, or 1.375 inches (34.9 mm) in diameter, etc. A common derivative is known as GU10 form factor. The GU10 form factor is distinguishable from other MR lamps by the presence of a ceramic base.

There are many configurations of LED lamps and contacts for LED lamps. It should be understood that embodiments of the present invention may also be adapted to these other configurations of lamps and contacts to provide features described herein. For example Table 1 gives standards (see "Type") and corresponding characteristics. The standard may include pin spacing, pin diameter, and usage information.

TABLE 1

| Type | Standard | Pin (center to center) | Pin Diameter | Usage |
|---|---|---|---|---|
| G4 | IEC 60061-1 (7004-72) | 4.0 mm | 0.65-0.75 mm | MR11 and other small halogens of 5/10/20 watt and 6/12 volt |
| GU4 | IEC 60061-1 (7004-108) | 4.0 mm | 0.95-1.05 mm | |
| GY4 | IEC 60061-1 (7004-72A) | 4.0 mm | 0.65-0.75 mm | |
| GZ4 | IEC 60061-1 (7004-64) | 4.0 mm | 0.95-1.05 mm | |
| G5 | IEC 60061-1 (7004-52-5) | 5 mm | | T4 and T5 fluorescent tubes |
| G5.3 | IEC 60061-1 (7004-73) | 5.33 mm | 1.47-1.65 mm | |
| G5.3-4.8 | IEC 60061-1 (7004-126-1) | | | |
| GU5.3 | IEC 60061-1 (7004-109) | 5.33 mm | 1.45-1.6 mm | |
| GX5.3 | IEC 60061-1 (7004-73A) | 5.33 mm | 1.45-1.6 mm | MR16 and other small halogens of 20/35/50 watt and 12/24 volt |
| GY5.3 | IEC 60061-1 (7004-73B) | 5.33 mm | | |
| G6.35 | IEC 60061-1 (7004-59) | 6.35 mm | 0.95-1.05 mm | |
| GX6.35 | IEC 60061-1 (7004-59) | 6.35 mm | 0.95-1.05 mm | |
| GY6.35 | IEC 60061-1 (7004-59) | 6.35 mm | 1.2-1.3 mm | Halogen 100 W 120 V |
| GZ6.35 | IEC 60061-1 (7004-59A) | 6.35 mm | 0.95-1.05 mm | |
| G8 | | 8.0 mm | | Halogen 100 W 120 V |
| GY8.6 | | 8.6 mm | | Halogen 100 W 120 V |
| G9 | IEC 60061-1 (7004-129) | 9.0 mm | | Halogen 120 V (US)/ 230 V (EU) |
| G9.5 | | 9.5 mm | 3.10-3.25 mm | Common for theatre use, several variants |
| GU10 | | 10 mm | | Twist-lock 120/230-volt MR16 halogen lighting of 35/50 watt, since mid-2000s |
| G12 | | 12.0 mm | 2.35 mm | Used in theatre and single-end metal halide lamps |
| G13 | | 12.7 mm | | T8 and T12 fluorescent tubes |
| G23 | | 23 mm | 2 mm | |
| GU24 | | 24 mm | | Twist-lock for self-ballasted compact fluorescents, since 2000s |
| G38 | | 38 mm | | Mostly used for high-wattage theatre lamps |
| GX53 | | 53 mm | | Twist-lock for puck-shaped under-cabinet compact fluorescents, since 2000s |

Again, although a particular mass or weight is not explicitly indicated by any of the form factors referred to in Table 1, for many applications both suppliers and consumers of LED illumination sources prefer lighter weight devices. Yet, for at least the aforementioned reasons, large heat sinks (sometimes massive passive heat sinks) are often used.

An LED assembly may be used within LED lighting sources 100 and 110. In certain embodiments, highly efficient and bright LED sources can be used, e.g., LED lighting source 100, that output a peak output brightness from approximately 7600 candelas to 8600 candelas (with approximately 360 lumens to 400 lumens), with peak output brightness of approximately 1050 candelas to 1400 candelas for a 40 degree flood light (weighing approximately 510 grams to 650 grams), and approximately 2300 candelas to 2500 candelas for a 25 degree flood light (weighing approximately 620 lumens to 670 lumens). Therefore, in various embodiments of LED lighting sources, the output brightness is at least about the same brightness as a conventional halogen bulb MR-16 light.

Suitable methods and apparatus to remove and/or dissipate the heat generated by the LED assembly are desired. Some attempts have been made to produce LED lighting sources (e.g., LED lighting source 100 and LED lighting source 110) that are lighter in weight and are sufficient to carry away and/or dissipate the heat generated by the LED assembly. Examples of passive (e.g., solid state, without moving parts) heat dissipating LED assemblies are presented in Table 2. It is noted that the last manufacturer on the list, Soraa, is the current assignee of the present application, and products manufactured by the assignee incorporate embodiments of the present invention.

TABLE 2

| Manufacturer | Watts | Beam | CBCP | Lumens | Weight (g) | Ratio (L/g) |
|---|---|---|---|---|---|---|
| LedEngin | 5.6 | 23 | 1060 | 185 | 62 | 2.98 |
| Samsung | 4 | 25 | 400 | 200 | 48 | 4.17 |
| LedNovation | 3.9 | 27 | 1100 | 250 | 60 | 4.17 |
| LSG | 6 | 25 | 768 | 300 | 50 | 6.00 |
| Toshiba | 6.7 | 25 | 1250 | 310 | 49 | 6.33 |
| Nexxus | 6.5 | 18 | 2693 | 332 | 48 | 6.92 |
| CRS | 6 | 20 | 1700 | 300 | 43 | 6.98 |
| CRS | 6 | 26 | 1200 | 300 | 43 | 6.98 |
| CRS | 6 | 38 | 500 | 300 | 43 | 6.98 |
| AZ e-lite | 10 | 24 | 1232 | 370 | 50 | 7.40 |
| LedNovation | 7.9 | 11 | 7360 | 450 | 60 | 7.50 |
| Samsung | 5.8 | 25 | 1640 | 350 | 45 | 7.78 |
| MSi | 5 | 30 | 1410 | 330 | 42 | 7.86 |
| Soraa | 12 | 24 | 2450 | 500 | 30 | 16.67 |

Active heat dissipating LED assemblies have also been produced that incorporate a cooling device, e.g., fan that blows air across a heat sink. Although the one design disclosed below is relatively lighter than many of the passive LED assemblies identified in Table 1, there are drawbacks to active cooling. One drawback is long-term product reliability of actively cooled LED lighting sources. Because such lights include moving mechanisms (i.e. are not solid state), the chance of a cooling mechanism failing is much higher than in passive methods. It is believed that long-term reliability of such lights is important, as such lights may be placed within relatively inaccessible areas, e.g., cleanrooms, 20 foot high ceilings, high traffic areas, etc. Another drawback includes increased fire risk. If an active cooling device (e.g., a fan) or a heat sink of the light source can became caked with dust and/or stop blowing, the light source would generate more heat than could be safely dissipated. Accordingly, any dust or dirt caught in the light source could be subject to extremely high heat and possibly catch on fire. Yet another drawback is that lights with active cooling (e.g., fans) would generate more noise than light sources with passive cooling. One light source with active cooling is presented below in Table 3.

TABLE 3

| Manufacturer | Watts | Beam | CBCP | Lumens | Weight (g) | Ratio (L/g) |
|---|---|---|---|---|---|---|
| Philips | 10 | 24 | 1990 | 475 | 35 | 13.57 |

In certain embodiments, an illumination source provided by the present disclosure outputs a ratio of lumens per gram within the range of about 10 lumens per gram to about 17 lumens per gram, within a range of about 17 lumens per gram to about 20 lumens per gram, within a range of about 20 lumens per gram to about 25 lumens per gram, and in some embodiments over 25 lumens per gram. In certain embodiments, an illumination light source provided by the present disclosure comprises an MR-16 form factor heat sink coupled to the LED assembly wherein the illumination source outputs within ranges from about 16 lumens per gram to about 18 lumens per gram, from about 18 lumens per gram to about 20 lumens per gram, from about 20 lumens per gram to about 22 lumens per gram, and from about 25 lumens per gram to about 30 lumens per gram.

Figure 2A:
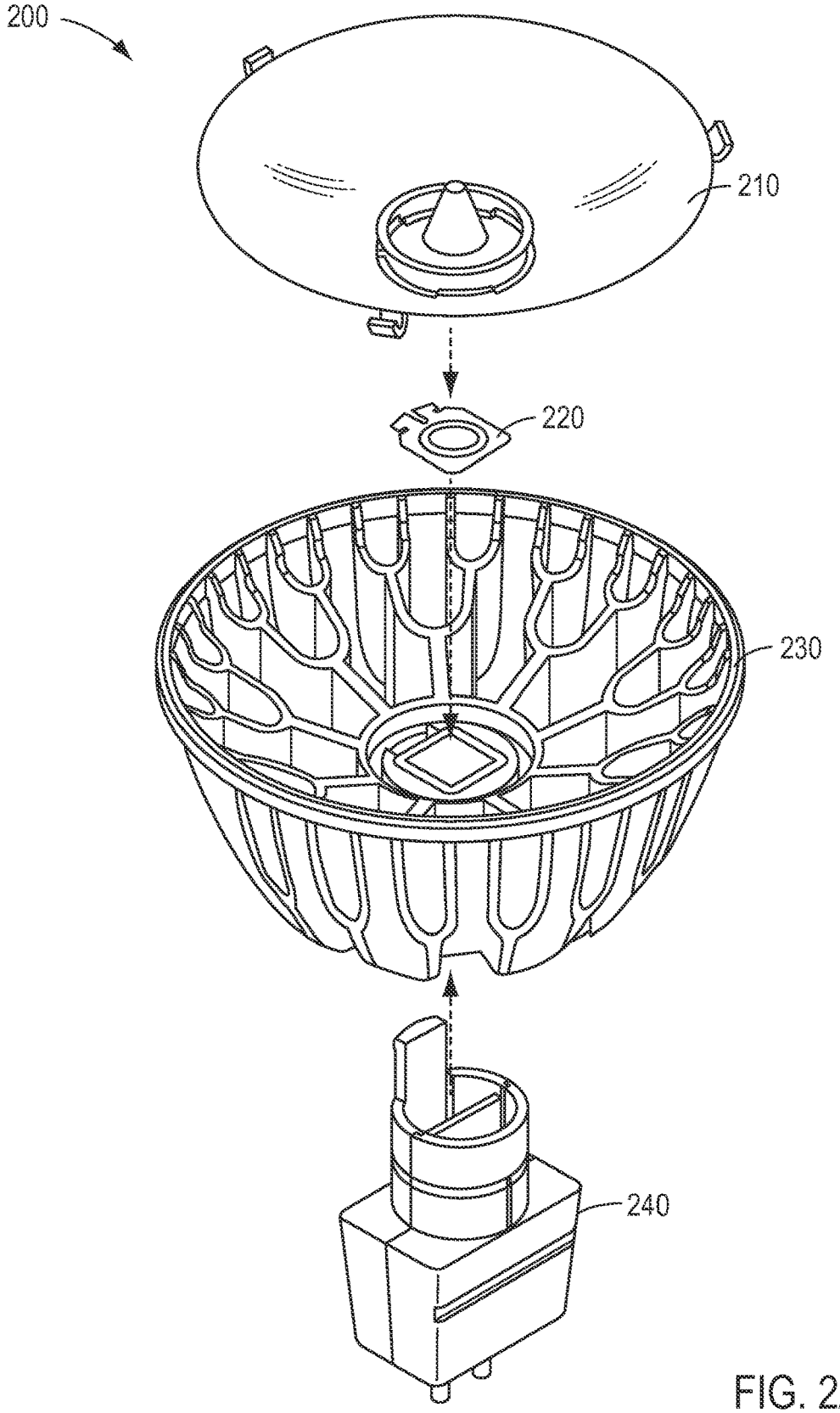
FIG. 2A illustrates an exploded view of the apparatus of FIG. 1A and FIG. 1B.
Figure 2B:
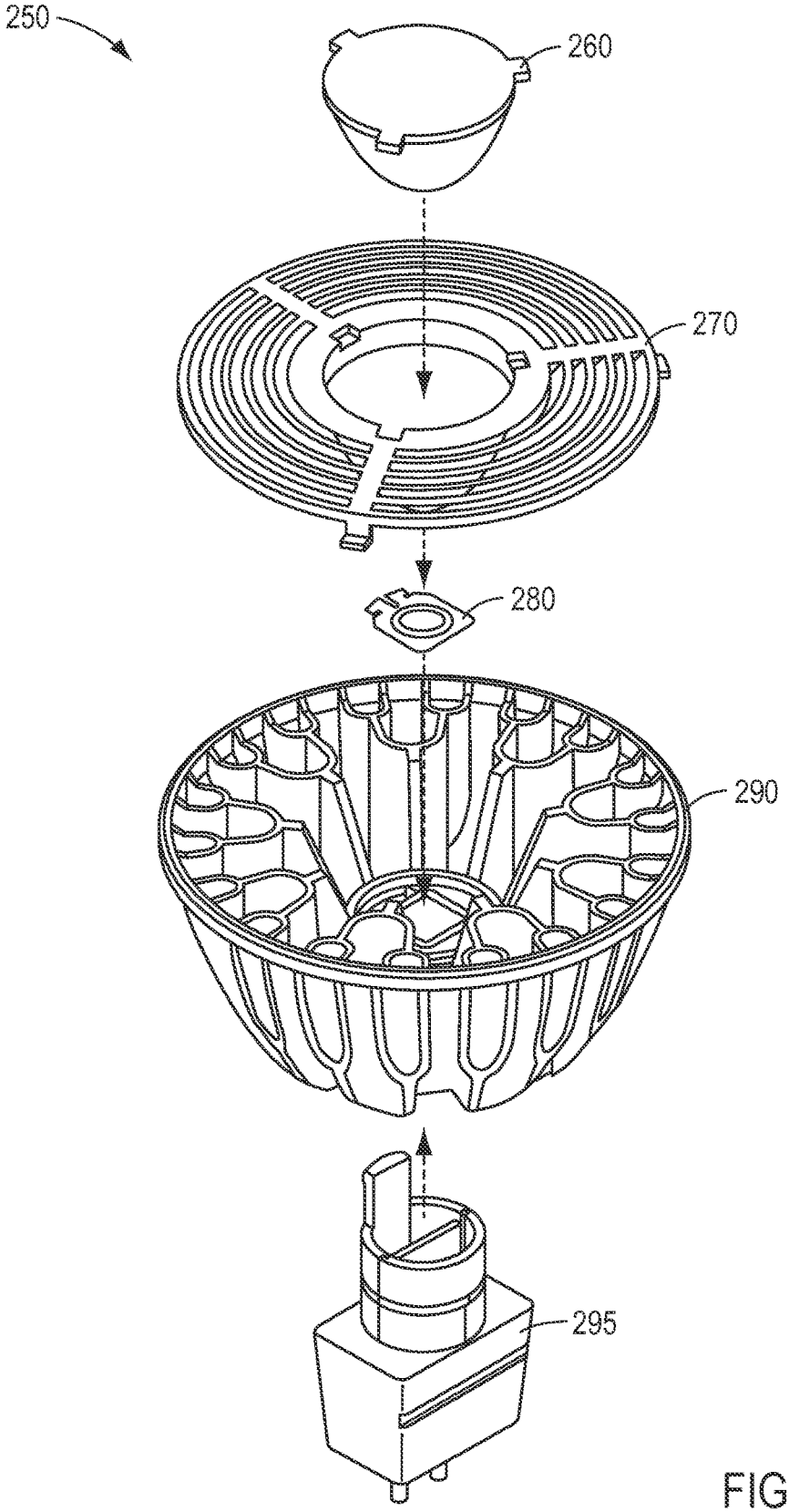
FIG. 2B illustrates an exploded view of the apparatus of FIG. 1A and FIG. 1B.

FIG. 2A and FIG. 2B are diagrams illustrating exploded views of FIG. 1A and FIG. 1B. FIG. 2A illustrates a modular diagram of a spot light 200, and FIG. 2B illustrates a modular diagram of a flood light 250.

Spotlight 200 includes a lens 210, an LED assembly module 220, a heat sink 230, and a base assembly module 240. Flood light 250 includes a lens 260, a lens holder 270, an LED assembly module 220, a heat sink 290, and a base assembly module 295. The modular approach to assembling spotlight 200 or flood light 250 reduces manufacturing complexity and cost, and increases the reliability of such lights.

Lens 210 and lens 260 may be formed from a UV resistant transparent material, such as glass, polycarbonate material, or the like. Lens 210 and 260 may be used to create a folded light path such that light from the LED assembly 220 or 280 reflects internally more than once before being output. Such a folded optic lens enables spotlight 200 and 250 to have a tighter columniation of light than is normally available from a conventional reflector of equivalent depth.

To increase durability of the lights, the transparent material is operable at an elevated temperature (e.g., 120 degrees C.) for a prolonged period of time, e.g., hours. One material that may be used for lens 210 and lens 260 is Makrolon™ LED 2045 or LED 2245 polycarbonate available from Bayer Material Science AG. In certain embodiments, other suitable materials may also be used.

In FIG. 2A, lens 210 is secured to heat sink 230 via clips on the edge of lens 210. Lens 210 may also be secured via an adhesive proximate to where LED assembly 220 is secured to heat sink 230. In FIG. 2B, lens 260 is secured to a lens holder 270 via tabs on the edge of lens 260. In turn, lens holder 270 may be secured to heat sink 290 by one or more tabs on the edge of lens holder 270, as illustrated. Lens holder 270 is preferably white plastic material to reflect scattered light through the lens. Other suitable heat resistant material may also be used for lens holder 270.

LED assembly 220 and LED assembly 280 may be of similar construction, and thus interchangeable during the manufacturing process. In certain embodiments, LED assemblies may be selected based upon lumen-per-watt efficacy. In some examples, an LED assembly having a lumen per watt (L/W) efficacy from 53 L/W to 66 L/W is used for 40 degree flood lights, an LED assembly having an efficacy of approximately 60 L/W is used for spot lights, an LED assembly having an efficacy of approximately 63 L/W to 67 L/W is used for 25 degree flood lights, etc.

In certain embodiments, LED assembly 220 and LED assembly 280 include 36 LEDs arranged in series, in parallel-series, e.g., three parallel strings of 12 LEDs in series, or in other configurations.

In certain embodiments, the targeted power consumption for the LED assemblies is less than 13 watts. This is much less than the typical power consumption of halogen-based MR16 lights (50 watts). As a result, certain embodiments of the disclosure match the brightness or intensity of halogen based MR16 lights, but use less than 20% of the energy.

LED assembly 220 and 280 are secured to heat sinks 230 and 290, respectively. LED assemblies 220 and 280 may include a flat thermally conductive substrate such as silicon. (The operating temperature of LED assemblies 220 and 280 is on the order of 125 degrees C. to 140 degrees C.) The silicon substrate can be secured to the heat sink using a high thermal conductivity epoxy, e.g., thermal conductivity about 96 W/mk. Alternatively, a thermoplastic-thermoset epoxy may be used such as TS-369 or TS-3332-LD, available from Tanaka Kikinzoku Kogyo K.K. Other suitable epoxies, or other suitable fastening means may also be used. The thermally conductive substrate serves to spread the heat generated by the LED assembly and provide a thermally conductive path to the surface of the heat sink to which the thermally conductive substrate is mounted.

Heat sinks 230 and 290 may be formed from a material having a low thermal resistance and a high thermal conductivity. In certain embodiments, heat sinks 230 and 290 are formed from an anodized 6061-T6 aluminum alloy having a thermal conductivity of k=167 W/mk and a thermal emissivity of e=0.7. In certain embodiments, materials such as 6063-T6 or 1050 aluminum alloy having a thermal conductivity of k=225 W/mk and a thermal emissivity of e=0.9, or alloys such AL 1100, are used. Additional coatings may also be added to increase thermal emissivity, for example, paint from ZYP Coatings, Inc. using $CR_2O_3$ or $CeO_2$ provides thermal emissivity e=0.9; or Duracon™ coatings provided by Materials Technologies Corporation has a thermal emissivity e>0.98.

At an ambient temperature of 50 degrees C., and in free natural convection, heat sink 230 was measured to have a thermal resistance of approximately 8.5 degrees C./Watt, and heat sink 290 was measured to have a thermal resistance of approximately 7.5 degrees C./Watt. In certain embodiments, the thermal resistance of a heat sink can be as low as 6.6 degrees C./Watt.

Base assemblies or modules 240 and 295 in FIG. 2A and FIG. 2B provide a standard GU 5.3 physical and electronic interface to a light socket. Base modules 240 and 295 include high temperature resistant electronic circuitry used to drive LED modules 220 and 280. An input voltage of 12 VAC to the LEDs is converted to 120 VAC, 40 VAC, or other desired voltage by the LED driving circuitry.

The shell of base assemblies 240 and 295 is can be, for example, an aluminum alloy, formed from an alloy similar to that used for heat sink 230 and heat sink 290; for example, AL1100 alloy. To facilitate heat transfer from the LED driving circuitry to the shells of the base assemblies, a compliant potting compound such as Omegabond® 200, available from Omega Engineering, Inc., or 50-1225 from Epoxies, etc. may be used.

Generally, embodiments of LED light sources (e.g., spot light 200) includes two portions: a light generation portion (including lens 210, LED assembly 220, and module 240), and a heat dissipation portion (including heat sink 230).

Figure 3A:
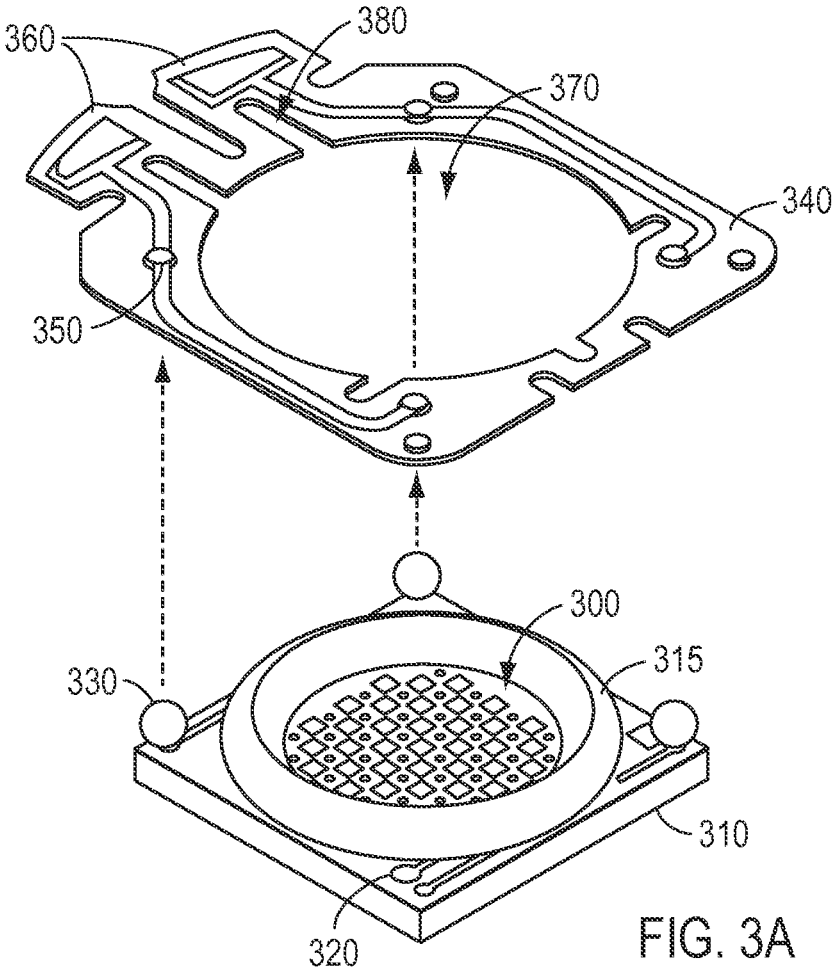
FIG. 3A illustrates LED assemblies for use with the apparatus of FIG. 1 and FIG. 2.
Figure 3B:
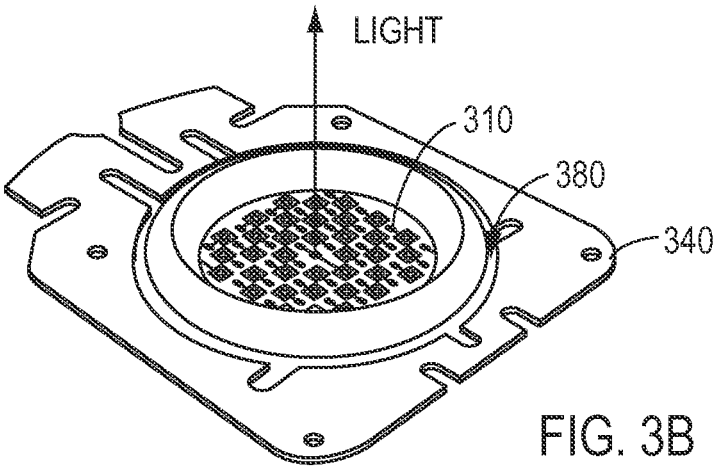
FIG. 3B illustrates LED assemblies for use with the apparatus of FIG. 1 and FIG. 2.

FIG. 3A and FIG. 3B illustrate an LED assembly for use with the lights described above. FIG. 3A illustrates an LED package subassembly, also referred to as an LED module. A plurality of LEDs 300 are affixed to a substrate 310. The LEDs 300 are connected in series and powered by a voltage source of approximately 120 volts AC. To enable a sufficient voltage drop (e.g., 3 to 4 volts) across each LED 300, 30 to 40 LEDs are used, e.g., 37 to 39 LEDs coupled in a series. In certain embodiments, LEDs 300 are connected in a parallel series and powered by a voltage source of approximately 40 VAC. In such implementations, LEDs 300 include 36 LEDs arranged in three groups each having 12 LEDs 300 coupled in series. Each group is thus coupled in parallel to the voltage source (40 VAC) provided by the LED driver circuitry such that a sufficient voltage drop (e.g., 3 to 4 volts) is provided across each LED 300. In certain embodiments, other driving voltages and other arrangements of LEDs 300 can be used.

LEDs 300 are mounted upon a silicon substrate 310 or other thermally conductive substrate, usually with a thin electrically insulating layer and/or a reflective layer separating LEDs 300 from the substrate 310. Heat from LEDs 300 is transferred to silicon substrate 310 and to a heat sink via a thermally conductive epoxy, as discussed herein.

In one embodiment, the silicon substrate is approximately 5.7 mm×5.7 mm, and approximately 0.6 microns thick. The dimensions may vary according to specific lighting requirements. For example, for a lower brightness intensity, fewer LEDs are mounted upon a smaller substrate.

As shown in FIG. 3A, a silicone ring 315 is disposed around LEDs 300 to define a well-type structure. In various embodiments, a phosphorus bearing material is disposed within the well structure. In operation, LEDs 300 can provide a blue light, violet light, or ultraviolet light. In turn, the phosphorous bearing material can be excited by the light from the LEDs and causing the light source to emit white light.

As illustrated in FIG. 3A, bonding pads 320 are provided upon substrate 310 (e.g., 2 to 4). Then, a conventional solder layer (e.g., 96.5% tin and 5.5% gold) may be used to provide solder balls 330 thereon. In the embodiments illustrated in FIG. 3A, four bonding pads 320 are provided, one at each corner, two for each power supply connection. In certain embodiments, only two bond pads may be used, one for each AC power supply connection.

Also illustrated in FIG. 3A is a flexible printed circuit (FPC) 340. FPC 340 that includes a flexible substrate material, such as a polyimide, Kapton™ from DuPont, or the like. As illustrated, FPC 340 has bonding pads 350 for electrical connections to substrate 310, and bonding pads 360 for connection to the supply voltage. An opening 370 provides for light from the LEDs 300.

Various shapes and sizes for FPC 340 may be used. For example, as illustrated in FIG. 3A, a series of cuts reduce the effects of expansion and contraction of FPC 340 compared to substrate 310. FPC 340 may be crescent shaped, and opening 370 may not be a thru hole. In certain embodiments, other shapes and sizes for FPC 340 can be used depending on the application.

In FIG. 3B, substrate 310 can be bonded to FPC 340 via solder balls 330, in a conventional flip-chip type arrangement to the top surface of the silicon. By making the electrical connection at the top surface of the silicon, the entire bottom surface of the silicon can be used to transfer heat to the heat sink. Additionally, this allows the LEDs bonded directly to the substrate to maximize heat transfer through the substrate rather than through a PCB material that typically inhibits heat transfer. Subsequently, an under fill operation is performed, e.g., with silicone, to seal the space 380 between substrate 310 and FPC 340. FIG. 3B shows the LED subassembly or module as assembled.

Figure 4A:
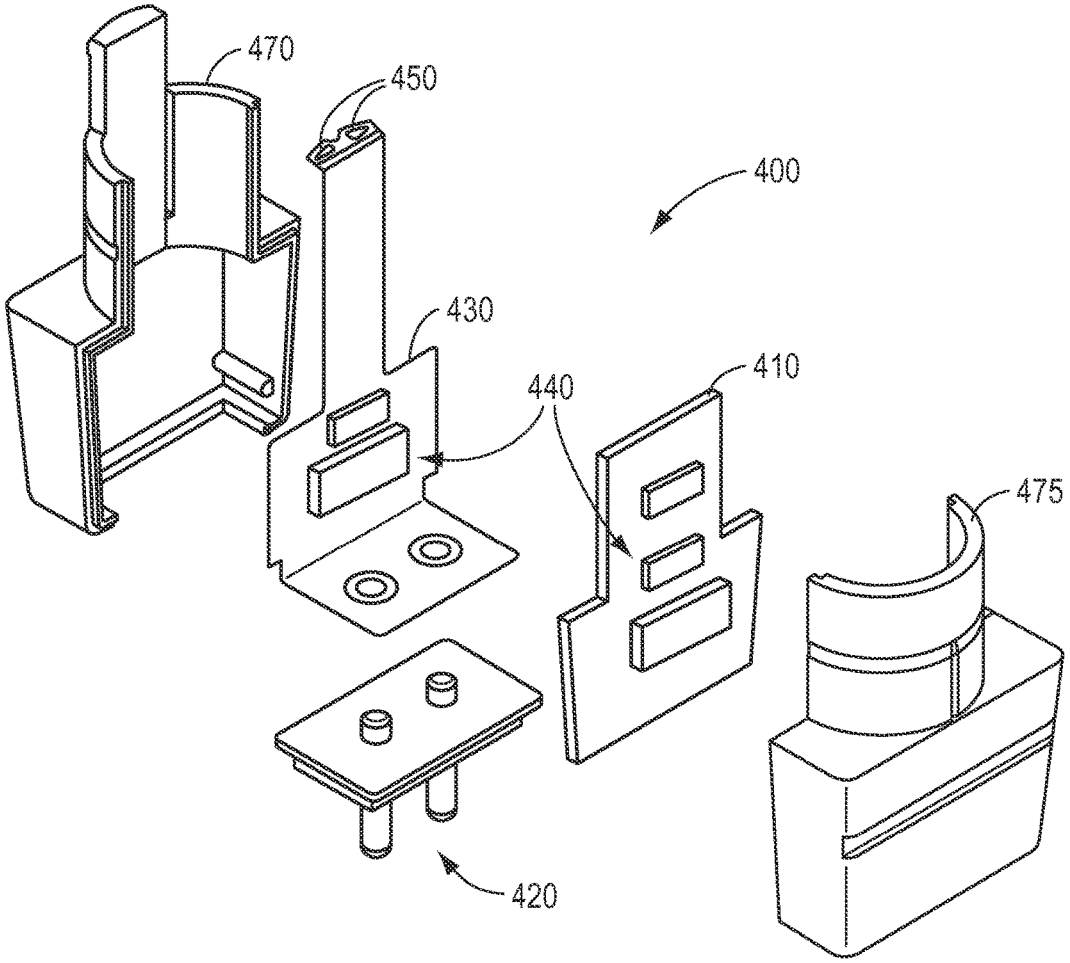
FIG. 4A illustrates an exploded view of a driver module and LED driver circuit according to certain embodiments of the present disclosure.
Figure 4B:
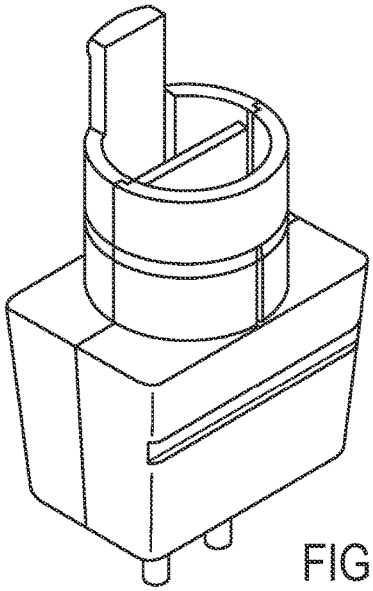
FIG. 4B illustrates a driver module and LED driver circuit according to certain embodiments of the present disclosure.

FIG. 4A and FIG. 4B illustrate a driver module or LED driver circuit 400 for driving the LED module described in FIG. 3A and FIG. 3B. Driver circuit 400 includes contacts 420, and a flexible printed circuit 430 electrically coupled to circuit board 410. Contacts 420 are conventional GU 5.3 compatible electrical contacts used to couple driver circuit 400 to the operating voltage. In certain embodiments, other base form factors for the electrical contacts can be used.

Electrical components 440 may be provided on circuit board 410 and on FPC 430. The electrical components 440 include circuitry that receives the operating voltage and converts it to an LED driving voltage. In FIG. 4A, the output LED driving voltage is provided at contacts 450 of FPC 430. These contacts 450 are coupled to bonding pads 360 of the LED module illustrated in FIG. 3A and FIG. 3B.

FIG. 4A also illustrates a base casing. The base casing includes two separate portions 470 and 475 molded, for example, from an aluminum alloy. As shown in FIG. 2A and FIG. 2B, the base casing can be mated to an MR-16 compatible heat sink.

The LED driver circuit 400 is disposed between portions 470 and 475, and contacts 420 and contacts 450 remain outside the assembled base casing. Portions 470 and portion 475 are then affixed to each other, e.g., welded, glued, or otherwise secured. Portions 470 and 475 include molded protrusions that extend toward LED circuitry 440. The protrusions may be a series of pins, fins, or the like, and provide a way for heat to be conducted away from the LED driver circuit 400 toward the base casing.

Lamps and lighting sources provided by the present disclosure operate at high operating temperatures, e.g., as high as 120° C. The heat is produced by electrical components 440, as well as heat generated by the LED module. The LED module transfers heat to the base casing via a heat sink. To reduce the heat load upon electrical components 440, a potting compound, such as a thermally conductive silicone rubber (Epoxies.com 50-1225, Omegabond® available from Omega Engineering, Inc., or the like) may be injected into the interior of the base casing in physical contact with LED driver circuits 400 and the base casing to help conduct heat from LED driver circuitry 400 outwards to the base casing.

Figure 5A:
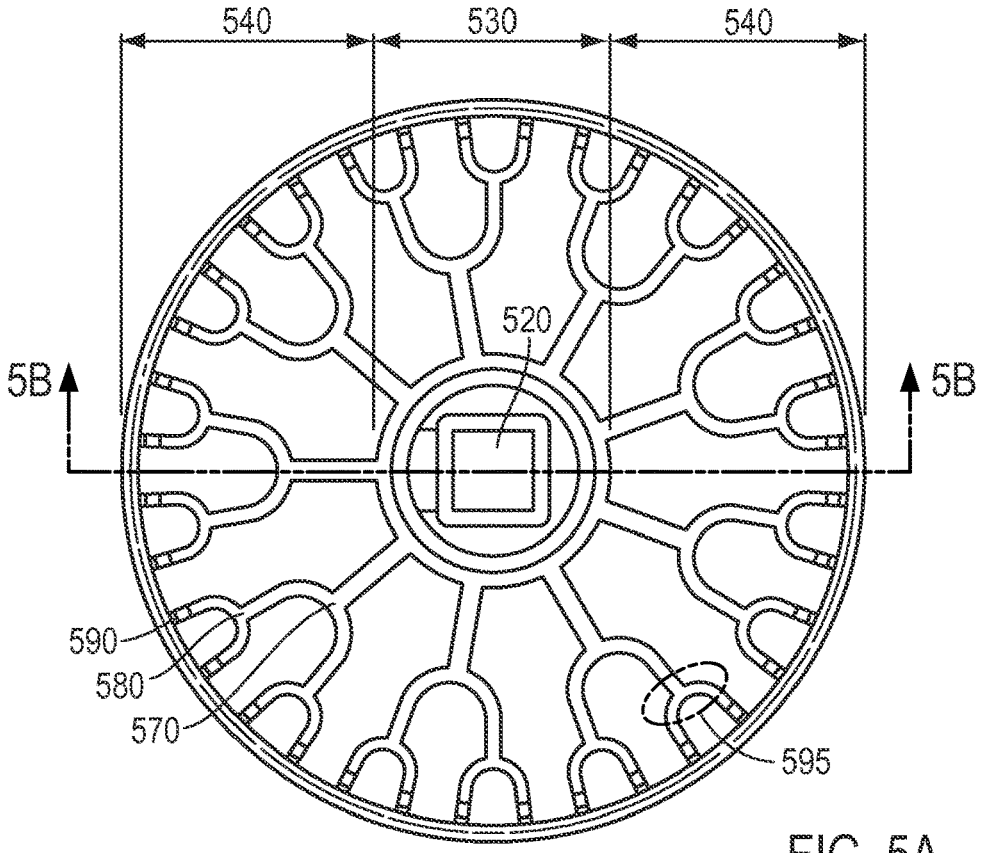
FIG. 5A illustrates a top view of a heat sink for an embodiment of a MR-16 compatible light source.
Figure 5B:
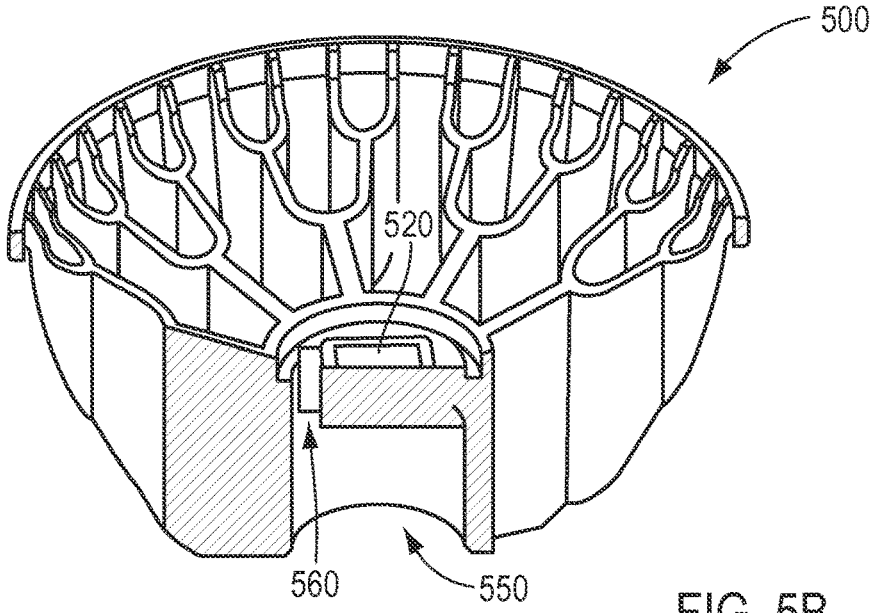
FIG. 5B illustrates a cross-sectional side view of a heat sink for an embodiment of MR-16 compatible light source.

FIG. 5A and FIG. 5B illustrate embodiments of a heat sink 500 for an MR-16 compatible spot light. Heat sink 500 can be fabricated, for example, from an aluminum alloy with low thermal resistance, e.g., black anodized 6061-T6 aluminum alloy having a thermal conductivity k=167 W/mk, and a thermal emissivity e=0.7. Other materials may also be used such as 6063-T6 or 1050 aluminum alloy having a thermal conductivity k=225 W/mk and a thermal emissivity e=0.9. In certain embodiments, still other alloys, such as AL 1100, may be used. Coatings may be added to increase thermal emissivity, for example, paint provided by ZYP Coatings, Inc. using $CR_2O_3$ or $CeO_2$ provides a thermal emissivity e=0.9, while Duracon™ coatings provided by Materials Technologies Corporation provides a thermal emissivity e>0.98; and the like.

As shown in FIG. 5A, a heat sink includes an inner core region 530 and an outer region 540. A relatively flat or planar section 520 is within inner core region 530 and an outer region 540. An LED module as described herein can be bonded to flat section 520 of inner core region 530, while outer region 540 serves to dissipate heat generated by the light and base modules. Inner core region 530 can be smaller than light generating regions of currently available MR-16 lights based on LEDs. As illustrated in FIG. 5A, the diameter of inner core region 530 can be less than one-third the diameter of outer region 540 such as, for example, about 30% of the diameter. Branching fins 570 a geometry configured to dissipate heat, thereby reducing the operating temperature of the LEDs and the LED driver circuitry.

In FIG. 5A, the top view of heat sink 500 illustrates a configuration of fins according to an embodiment of the present disclosure. A series of nine branching fins 570 is illustrated. Each heat fin includes a trunk region and branches 580. The branches 580 include sub-branches 590, and more sub-branches can be added if desired. Also, the ratios of the lengths of the trunk region, branches 580, and sub-branches 590 may be modified from the ratios illustrated. The thickness of the heat fins decreases toward the outer edge of the heat sink; for example, the trunk region is thicker than branches 580, that are, in turn, thicker than sub-branches 590.

Additionally, as shown in FIG. 5A and FIG. 5B, when branching fins 570 branch, they branch off in a two to one ratio and in a "U" shape 595. In various embodiments, the number of branches 580 extending from the trunk region, and the number of sub-branches 590 extending from and branches 580 may be modified from the number (two branches) illustrated. The heat dissipation performance of heat sinks using the principles discussed can be optimized for various conditions. For example, different numbers of branching fins 570 (e.g., 7, 8, 9, 10); different ratios of lengths of the trunks to branches, branches to sub-branches, different thicknesses for the trunks, branches, sub-branches; different branch shapes; and different branching patterns can be used.

In FIG. 5B, a cross-section of heat sink 500 is illustrated including an interior channel 550. Interior channel 550 is adapted to receive the base module including the LED driver electronics, as described above. A narrower section 560 of interior channel 550 is also illustrated. The thinner neck portion of the LED driver module, including LED driving voltage contacts, (e.g., bonding pads) shown in FIG. 4A, can be inserted through the narrower section 560, and locked into place by tabs on the LED driver module.

Figure 6A:
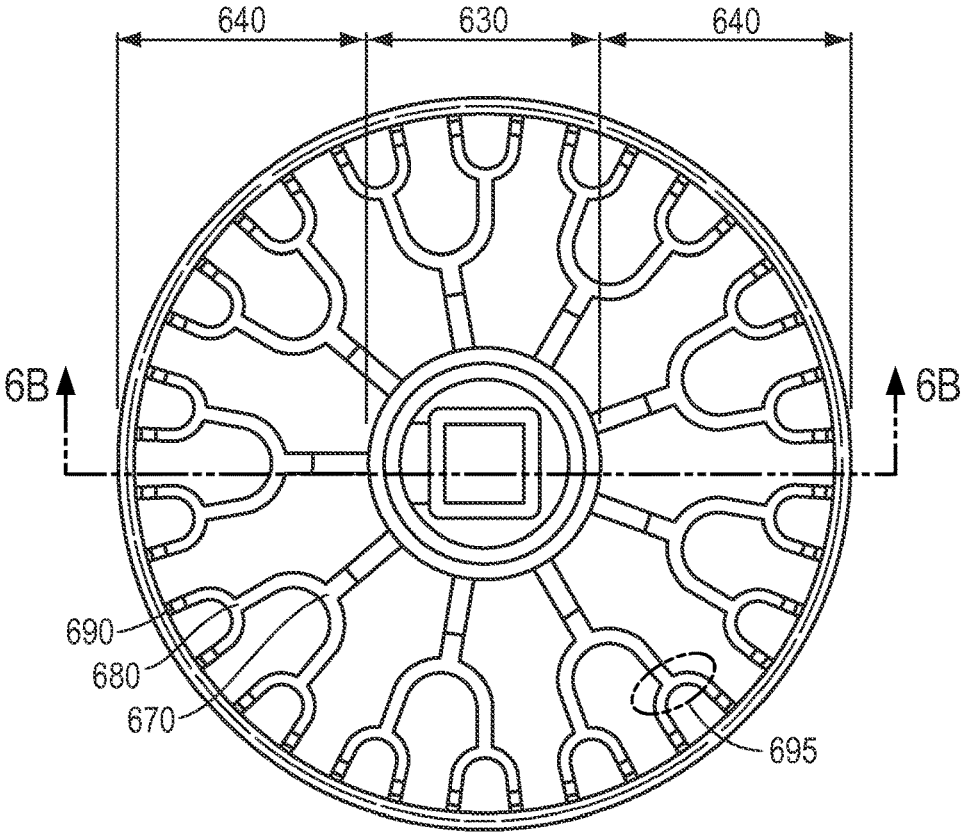
FIG. 6A illustrates a top view of a heat sink for an embodiment of a MR-16 compatible light source.
Figure 6B:
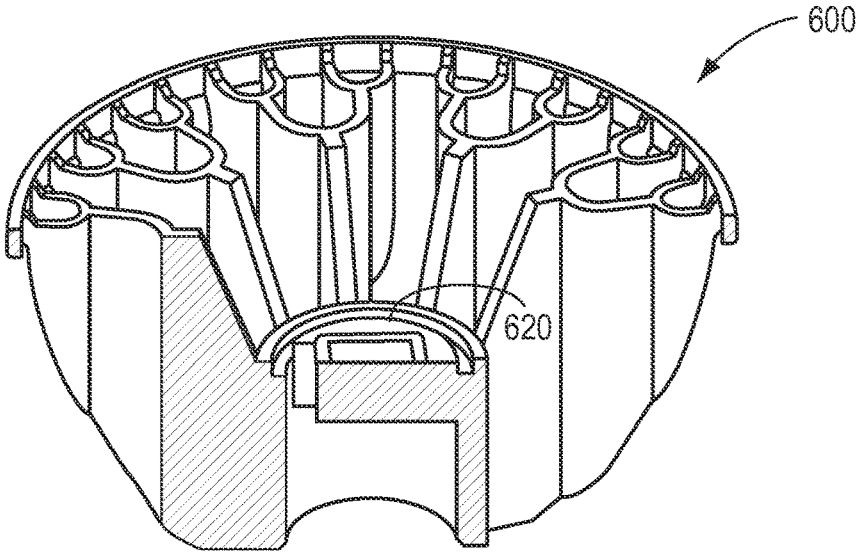
FIG. 6B illustrates a cross-sectional side view of a heat sink for an embodiment of a MR-16 compatible light source.

FIG. 6A and FIG. 6B illustrate another embodiment of the disclosure. More specifically, FIG. 6A and FIG. 6B illustrate an embodiment of a heat sink 600 for an MR-16 compatible flood light. The discussion above with respect to FIG. 5A and FIG. 5B is applicable to the flood light embodiment illustrated in FIG. 6A and FIG. 6B. For example, a heat sink 600 typically has a flat region 620 where an LED light module is bonded via a thermally conductive adhesive. Because the performance of the LED light module is higher, the LED light module is smaller, yet still provides the desired brightness. The inner core region 630 thus may be smaller in diameter and the outer region 640 also smaller than other MR-16 LED lights. As discussed with regard to FIG. 5A and FIG. 5B, any number of heat dissipating fins 670 may be provided in heat sink 600. Heat dissipating fins 670 have branches 680 and sub-branches 690, all with desired geometry 695 as discussed with regard to FIG. 5A and FIG. 5B.

Figure 7A:
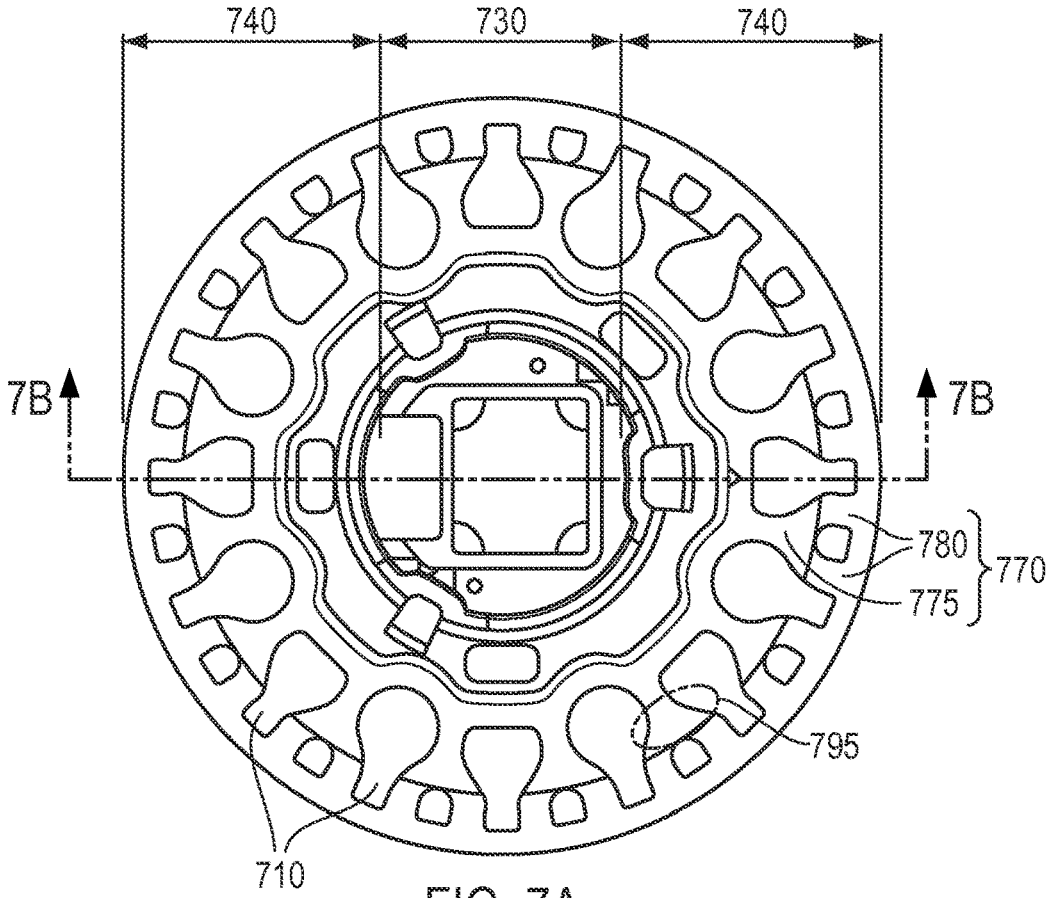
FIG. 7A illustrates a top view of a heat sink for an embodiment of a MR-16 compatible light source.
Figure 7B:
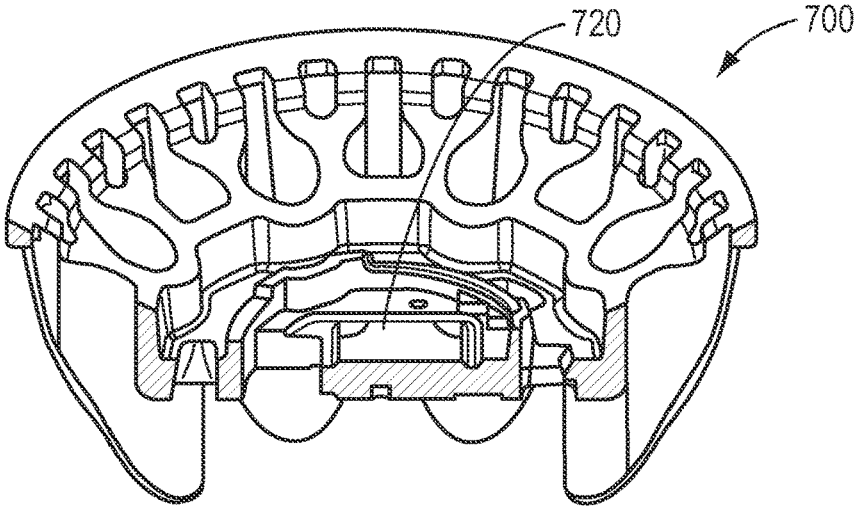
FIG. 7B illustrates a cross-sectional side view of a heat sink for an embodiment of a MR-16 compatible light source.
Figure 7C:
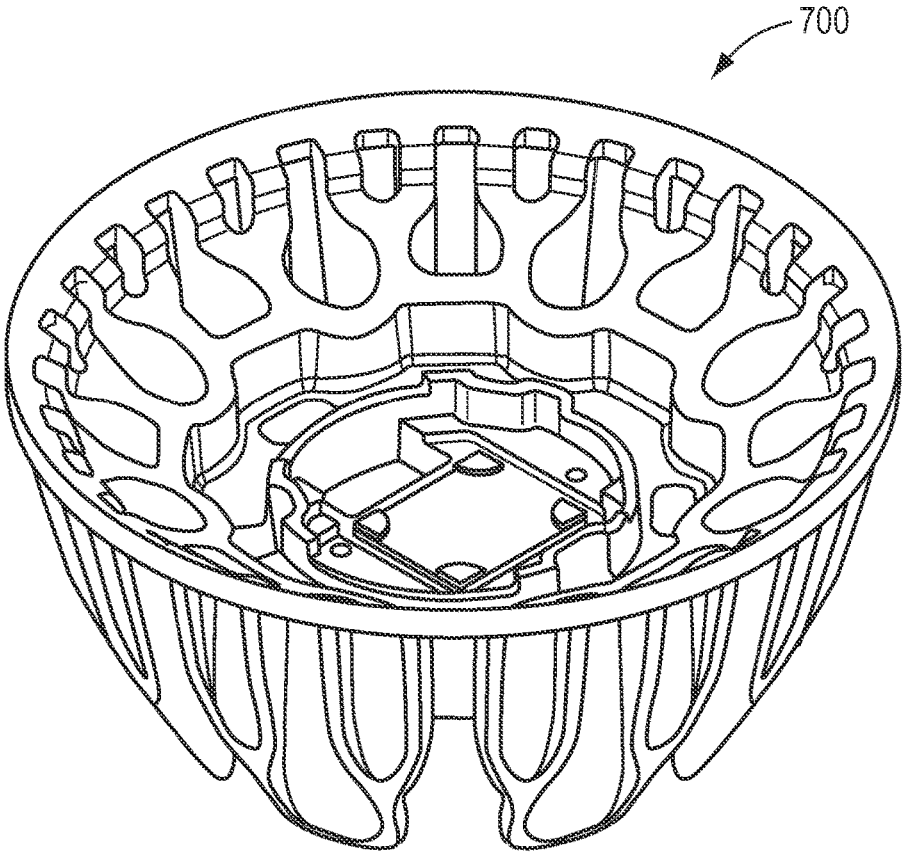
FIG. 7C is a perspective view of an MR-16 form factor implementation of certain embodiments provided by the disclosure.

FIGS. 7A to 7C illustrate other embodiments of the present disclosure. FIGS. 7A to 7C illustrate an embodiment of a heat sink 700 for an MR-16 compatible light. The discussion above with respect to FIGS. 5A and 5B and 6A and 6B may be applicable to the embodiments illustrated in FIGS. 7A to 7C. For example, a heat sink 700 typically has a flat region 720 in which an LED light module can be bonded via a thermally conductive adhesive. Because the performance of the LED light module is higher, the LED light module is smaller, yet still provides the desired brightness. The inner core region 730 thus may be smaller in diameter, and the outer region 740 also may be smaller in diameter with than other MR-16 LED lights.

As discussed with regard to FIGS. 5A, 5B, 6A, and 6B, any number of heat dissipating fins 770 may be provided in heat sink 700. Heat dissipating fins 770 typically include trunks 775 that extend from an inner core, and trunks can have branches 780, which can be Y, U, V-shaped geometry 795, or other geometry, as discussed with regard to FIG. 5A and FIG. 5B. In such embodiments, the trunks may also be separated by Y, U, V, flat-shaped geometry, or the like. As illustrated in FIGS. 7B and 7C, adjacent trunks may be coupled together by a U shaped geometric region 750 that extends downward in the shown orientation, and some trunks may be separated in region 760. The net effect of such embodiments is increased airflow within cavity 710, behind the inner core region 730, thereby increased increasing cooling capability. The outermost ends of each of the branches is coupled to a circular rim. As shown in FIG. 1B and FIG. 2B the circular rim can be used to attach devices such as a lens to the LED lighting source.

In certain embodiments, for example, as illustrated in FIGS. 5A and 6A, the radial length of the first trunk is approximately ⅔ (e.g., 70%) the radial length of the branches; and/or the radial length of a first branch is approximately ¾ (e.g., 80%) the radial length of a first trunks; and/or the radial length of a second branch is approximately ⅔ (e.g., 60%) the radial length of the first trunk. With respect to embodiments illustrated in FIG. 7A, the radial length of a first trunk can be approximately ⅔ (e.g., 60%) the radial length of a branch; and/or the radial length of a first branch is approximately ¾ (e.g., 66%) the radial length of the first trunk. In other embodiments, other ratios of first trunks to branches are contemplated. The shape of the heat dissipation fins can be configured to maximize heat dissipation. For example, as shown in FIGS. 7A to 7C certain fins having a trunk and branches can be closer to the inner core portion to bring circulating air closer to the inner core portion. Also as shown in FIGS. 7A to 7C the portions of the heat sink used primarily for heat dissipation are sufficiently thick to facilitate the flow of heat toward the outer portions of the outer region. In this regard the interface between the inner core portion and the outer portion of the heat sink comprises an approximately circular structure having a thickness or width approximately the same as the thickness of the trunks to which it is coupled.

Using the following the foregoing apparatus elements and methods, lightweight and high light output illumination lamps comprising an LED assembly to output light, and a passive MR-16 form factor heat sink coupled to the LED assembly, are provided.

In addition to the lightweight aspect and high light output aspects, the illumination source may be delivered in various embodiments including, for example:

- where the LED assembly includes at least 30 LEDs disposed upon a substrate;
- where the substrate comprises silicon having a width less than approximately 6 mm;
- where the first diameter is less than approximately 16 mm;

where the substrate comprises silicon coupled to the inner core region with thermally conductive adhesive;

where the silicon substrate has a width less than approximately 6 mm and the planar portion has a diameter of less than approximately 12 mm;

where the outer region includes a plurality of heat dissipating structures;

where the plurality of heat dissipating structures include a plurality of trunks and a plurality of branches with the trunks coupled to the inner core region and the branches coupled to the trunks;

where a ratio of radial length of the trunks to radial length of the plurality of branches is selected from a group consisting of: approximately 1:1, approximately 2:3, and approximately 1:2; and where the MR-16 form factor heat sink comprises an aluminum alloy having a thermal conductivity greater than approximately 167 W/mK.

The specification and drawings are illustrative of the designs and methods. Various modifications and changes may be made thereunto without departing from the broader spirit and scope of the claims.

What is claimed is:

1. An illumination source comprising:

at least one light emitting diode (LED) assembly comprising at least one LED, wavelength-converting material over said at least one LED, and a substrate on which said at least one LED is disposed, said substrate having a first area, said LED assembly being configured to output light at a first intensity while generating a first quantity of heat per unit time;

a lens optically coupled to said at least one LED assembly and configured to receive said light and emit a beam of said light from said illumination source;

a heat dissipation portion thermally coupled to said substrate of said at least one LED assembly such that heat generated by said at least one LED flows from said at least one LED, through said substrate, and into said heat dissipation portion, —wherein the heat dissipation portion is discrete from said at least one LED assembly and configured to dissipate passively without a fan at least the first quantity of heat per unit time, said heat dissipation portion having an outer periphery, thereby defining a second area, wherein said first area is less than 10% of said second area;

wherein said at least one LED assembly and the heat dissipation portion are collectively characterized by a first mass; and wherein a ratio of the first intensity to the first mass is from 10 lumens per gram to 30 lumens per gram.

2. The illumination source of claim 1, wherein the LED assembly comprises a plurality of LEDs disposed upon said substrate.

3. The illumination source of claim 2, wherein the substrate comprises silicon having a width of 6 mm.

4. The illumination source of claim 1, wherein the heat dissipation portion comprises an MR-16 form factor heat sink.

5. The illumination source of claim 4, wherein the MR-16 form factor heat sink comprises an inner core region having a first diameter and is planar, and an outer region having a second diameter; wherein the first diameter is less than 16 mm.

6. The illumination source of claim 5, wherein the LED assembly is disposed on a substrate, wherein the substrate is thermally coupled to the inner core region with thermally conductive adhesive.

7. The illumination source of claim 6, wherein the substrate has a width of 6 mm and the first diameter is 12 mm.

8. The illumination source of claim 5, wherein the outer region comprises a plurality of heat dissipating structures.

9. The illumination source of claim 8, wherein the plurality of heat dissipating structures comprises a plurality of trunks and a plurality of branches, wherein each of the plurality of trunks is coupled to the inner core region and each of the plurality of branches is coupled to at least one of the plurality of trunks.

10. The illumination source of claim 9, wherein a ratio of a radial length of the plurality of trunks to a radial length of the plurality of branches is selected from 1:1, 2:3, and 1:2.

11. The illumination source of claim 4, wherein the MR-16 form factor heat sink comprises an aluminum alloy characterized by a thermal conductivity from 167 W/mK to 225 W/mK.

12. The illumination source of claim 1, wherein the ratio of the intensity to the mass is from 16 lumens per gram to 20 lumens per gram.

13. The illumination source of claim 1 wherein the intensity is from 500 lumens to 650 lumens.

14. The illumination source of claim 13, wherein the mass is 30 grams.

15. The illumination source of claim 1, wherein said at least one LED assembly is characterized by an efficiency from 50 lumens per watt to 70 lumens per watt.

16. The illumination source of claim 15, wherein the illumination source is characterized by a power consumption of 12 watts.

17. The illumination source of claim 1, wherein the heat dissipation portion comprises a plurality of heat dissipating structures comprising a plurality of trunks and a plurality of branches, wherein each of the plurality of trunks is coupled to an inner core region of the heat sink and each of the plurality of branches is coupled to at least one of the plurality of trunks.

18. The illumination source of claim 4, wherein the heat dissipation portion comprises a first plurality of trunks coupled to a first plurality of branches, each of the first plurality of branches coupled to a second plurality of branches, and the second plurality of branches coupled to an external rim of the MR-16 form factor heat sink.

19. The illumination source of claim 4, wherein the heat dissipation portion comprises a first plurality of trunks coupled to a first plurality of branches, and each of the first plurality of branches coupled to an external rim of the MR-16 form factor heat sink.

20. The illumination source of claim 1, wherein said light generation portion is a single portion.

21. The illumination source of claim 20, wherein said light generation portion is centered in said heat dissipation portion.

* * * * *